US012735902B2

(12) United States Patent
Paik

(10) Patent No.: US 12,735,902 B2
(45) Date of Patent: Sep. 15, 2026

(54) ACOUSTIC FLOORING ASSEMBLY

(71) Applicant: Cary Paik, New York, NY (US)

(72) Inventor: Cary Paik, New York, NY (US)

( * ) Notice: Subject to any disclaimer, the term of this patent is extended or adjusted under 35 U.S.C. 154(b) by 0 days.

(21) Appl. No.: 18/109,902

(22) Filed: Feb. 15, 2023

(65) Prior Publication Data

US 2024/0271433 A1 Aug. 15, 2024

(51) Int. Cl.
*E04F 15/10* (2006.01)
*E04F 15/02* (2006.01)

(52) U.S. Cl.
CPC ..... *E04F 15/107* (2013.01); *E04F 15/02038* (2013.01); *E04F 2015/02116* (2013.01); *E04F 2201/023* (2013.01); *E04F 2203/06* (2013.01); *E04F 2290/043* (2013.01)

(58) Field of Classification Search
CPC . E04F 15/023; E04F 15/02038; E04F 15/107; E04F 15/102; E04F 2201/042; E04F 2201/0107; E04F 15/18; E04F 2201/03; E04F 2201/0552; E04F 2201/02116; E04F 2201/0535; E04F 2201/0146; E04F 2201/043; E04F 2201/0547; E04F 2201/0153; E04F 2290/043; E04F 2203/06
See application file for complete search history.

(56) References Cited

U.S. PATENT DOCUMENTS

| | | | | |
|---|---|---|---|---|
| 5,103,614 | A * | 4/1992 | Kawaguchi | E04F 15/181 52/392 |
| 10,343,381 | B2 * | 7/2019 | Troendle | B32B 5/18 |
| 10,563,412 | B1 * | 2/2020 | Paik | B32B 5/26 |
| 10,662,656 | B2 * | 5/2020 | Troendle | B32B 27/304 |
| 12,109,790 | B1 * | 10/2024 | Drevet | B32B 27/40 |
| 12,251,913 | B2 * | 3/2025 | Collison | B32B 21/14 |
| 2004/0255538 | A1 * | 12/2004 | Ruhdorfer | B32B 37/10 52/506.01 |
| 2008/0152876 | A1 * | 6/2008 | Magnusson | C09D 5/34 427/140 |
| 2009/0183457 | A1 * | 7/2009 | Boucke | B32B 21/042 52/425 |
| 2016/0088941 | A1 * | 3/2016 | Snowbarger | B32B 15/08 156/306.6 |
| 2017/0274840 | A1 * | 9/2017 | Paik | B60R 13/083 |
| 2017/0298639 | A1 * | 10/2017 | Song | B32B 21/08 |
| 2020/0325689 | A1 * | 10/2020 | Li | E04F 13/18 |
| 2021/0046742 | A1 * | 2/2021 | Rosbrook | B32B 27/32 |
| 2021/0049742 | A1 * | 2/2021 | Rozanski | G06T 5/50 |
| 2021/0164238 | A1 * | 6/2021 | Kuritz | B32B 27/365 |
| 2022/0048279 | A1 * | 2/2022 | Troendle | B32B 5/18 |

* cited by examiner

*Primary Examiner* — Chi Q Nguyen
(74) *Attorney, Agent, or Firm* — Alozie Etufugh, Esq.

(57) ABSTRACT

A flooring assembly comprising a flooring unit comprising
a stability core layer having a plurality of edge surfaces, two of which have an interlocking mechanism for attachment to the edge surfaces of the stability core of adjacent flooring units;
a plurality of sound attenuating acoustic layers attached to the bottom surface of the stability core layer; and
a finish layer attached to the top surface of said stability core layer.

20 Claims, 1 Drawing Sheet

ACOUSTIC FLOORING ASSEMBLY

BACKGROUND OF THE INVENTION

Flooring assemblies comprising flooring elements configured to be joined together to form finished floors having acoustic, sound-attenuating properties meeting or surpassing building sound code requirements (STC and IIC ratings) are highly desirous in the building industry. These codes require a high degree of suppression of sound transmissions between floors of buildings. Conventionally employed flooring elements may comprise multi-layer installations consisting of composite laminates having acoustic, sound-attenuating properties adapted for attachment thereof to subfloor substrates.

The most common forms of attachment to subfloors of floor assemblies constructed of conventional flooring elements are mechanical in nature; i.e., nails, staples, bolts, screws, and the like. The penetration of the acoustic, sound-attenuating portions of these assemblies with such rigid attachment elements, however, provide sound bridges which result in the direct transmission of vibrational energy, particularly sound energy, through the acoustic layer, thereby deleteriously affecting the sound-attenuating properties thereof and reducing the assemblies ability to maintain code and above levels of STC and IIC ratings. This vibrational energy typically manifests as noise, in a range of low, medium and high frequencies.

The effects of these noise transmitting rigid attachment elements are particularly objectionable in multi-unit buildings, such as condominiums, apartment buildings, and the like where units are stacked one above the other. For example, if two units of the multi-unit building, such as a first dwelling area and a second dwelling area located immediately above the first dwelling area, are separated by flooring assemblies attached to the building structure with sound-bridging mechanical attachment elements, vibrations generated in the second area are transmitted to the first area as noise or other sounds, thereby disturbing the enjoyment of the first area and potentially failing to meet code requirements.

In applicant's U.S. Pat. No. 11,313,137, there is described thinner and more economical flooring assemblies comprising flooring elements configured to be joined together to form finished floors having acoustic, sound-attenuating properties which are capable of being attached to building structures such as subfloor substrates in a one-step installation process without creating vibrational energy transmitting sound-bridges through the acoustic portions thereof, even where the flooring assemblies are mechanically attached to structures.

It is an object of the present invention to provide alternative flooring assemblies which are less expensive and easier to install while being more resilient to a wider range of noise frequencies than those described above.

SUMMARY OF THE INVENTION

The above and other objects are realized by the present invention, one embodiment of which relates to a flooring assembly comprising at least one flooring unit, each at least one flooring unit consisting of a single stability core layer having a top surface, a bottom surface and a plurality of edge surfaces, at least two of the edge surfaces having an interlocking mechanism for attachment to the edge surfaces of a single stability core of adjacent flooring units; a plurality of sound attenuating acoustic layers attached to the bottom surface of the single stability core layer; and a finish layer attached to the top surface of the single stability core layer, wherein: (1) each of the single stability core layer and the sound attenuating acoustic layers are polygonal, and (2) the assembly is attachable to a surface of a structure.

Optionally, (3) the edges of the sound attenuating acoustic layers in each of the at least one flooring unit overlap the edges of the sound attenuating acoustic layers of adjacent flooring units.

The flooring assembly of the invention is constructed as to be easily attachable to a surface of a building structure

DETAILED DESCRIPTION OF THE INVENTION

The invention is predicated on the discovery that flooring assemblies constructed from flooring units as described above effectively isolate any rigid mechanical connecting elements from the finish floor layer thereby avoiding any direct transmission of sound energy between the finish layer and the building structure. Sound energy sources can vary broadly from music to heels to appliances and cover a broad range of frequencies. Products for acoustic sound attenuation are generally of a dominant material and thus attenuates in the frequency range the material characteristics allow due to mass, density, air mixture, etc., so we find it advantageous to be able to add multiple acoustic sound attenuating layers that could each specifically address frequency ranges that need attenuation that one single material does not have the capacity to cover.

Embodiments of the present disclosure will be described with reference to the drawings. While various exemplary and preferred embodiments will be described, the disclosure is not limited thereto. On the contrary, various modifications and similar arrangements (as would be apparent to those skilled in the art) are intended to also be covered. Therefore, the scope of the appended claims should be accorded the broadest possible interpretation so as to encompass all such modifications and similar arrangements.

Figure 1:
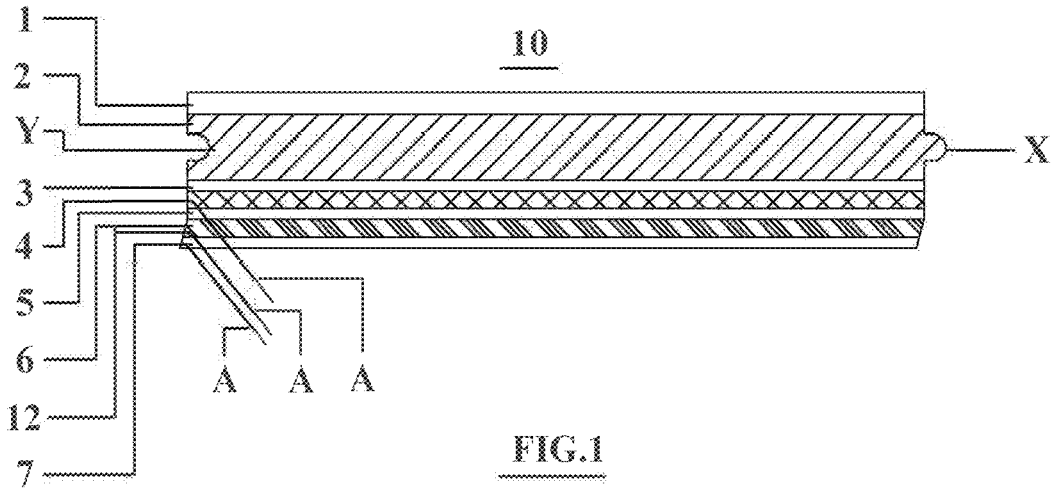
FIG. 1 is a side elevation view of the flooring unit of the invention.
Figure 2:
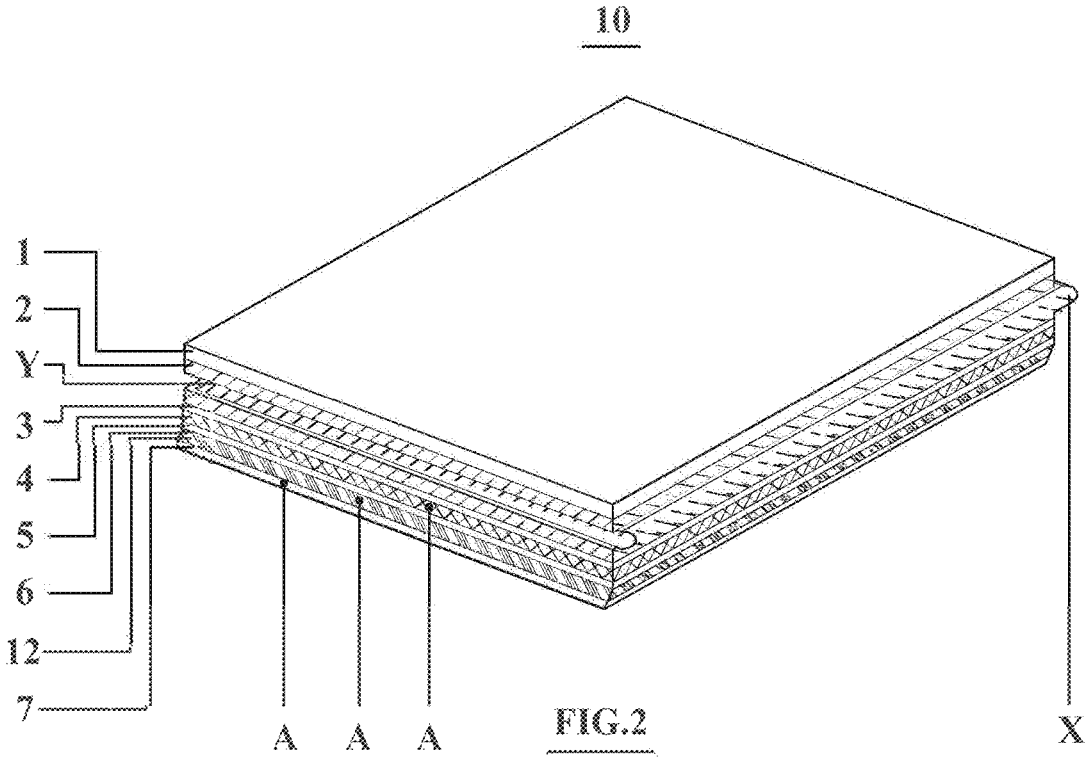
FIG. 2 is an axonometric view of the flooring unit of the invention.

Referring to FIGS. 1 and 2, a flooring unit 10 is shown. The unit 10 includes a first polygonal stability core layer 2 having an interlocking mechanism; for example, tongue x and groove y construction along at least two, preferably opposed, lateral edges for attachment to the edge surfaces of the stability core layer of an adjacent flooring unit. To the bottom surface of the stability core layer 2 are attached first and second sound attenuating acoustic layer 4 and 6; it being understood that more than two such layers may be so attached. Preferably, each acoustic layer is focused to help better attenuate wider frequency ranges and sound levels as noted above. Optionally, although not required, filler layer 3 and backing layer 5 may be attachably interposed between stability core layer 2 and sound attenuating acoustic layer 4 and between the latter and sound attenuating acoustic layer 6, respectively. On the top surface of the stability core layer 2 is attached a finish layer 1.

To the bottom surface of the acoustic layer 6, an optional protection layer 7 (further described below) may be attached. The filler, backing, and protection layers are employed in order to manage the thickness of the assembly, ease of manufacturing, protection of layers and maintain material balance, where required.

Each of layers 1-3 and 5 are preferably identically polygonal in shape that may take any form, such as, for example, rectangular (boards, sheets, and the like) or square (tiles and the like). Each of the above-described layers may be attached to each other by any suitable means; most preferably, adhesively.

The assembly of flooring units of the invention is attachable to a surface of a building structure; e.g., a sub-flooring surface by (1) an adhesive, (2) a mechanical connector, or (3) a combination of (1) and (2).

Thus, a primary advantage of the flooring units of the invention is that they may be assembled and attached to a building structure, such as, for example, a sub-floor to achieve an acoustic floor having no penetrating mechanical connections or rigid penetrations [such as nails] completely through both "acoustic layer" 4 and 6 which would allow sound to bridge the layer, thereby denigrating the sound attenuating properties thereof, and achieving, at the same time, a durable connection between the building structure and the acoustic floor assembly. This is enabled by the unique construction of the flooring units which allows the mechanical connection to occur anywhere in the lower portion of the acoustic layer 4, the backing layer 5 or through the lower portion of the acoustic layer 6 or the protection layer 7.

Referring to FIGS. 1 and 2, the preferred mechanical connection locations are in the lower portions A of the acoustic layers 4 and 6 and protective layer 7 so that, if desired though not necessary, it may be covered by an optionally overlapping acoustic layer from the adjoining piece of flooring or in the protection layer 7, thus avoiding altogether any acoustic penetrations through the acoustic layers that may bridge any sound from the top finish surface 1 to the building structure. The mechanical connector may take any suitable form, such as, for example, nail, screw, staple, bolt, clip, snap, and the like.

Previously, the method of construction and attachment of conventional prior art acoustic flooring assemblies required the following steps:

(1) An acoustic layer having the required sound-attenuating value is installed on a subfloor.

(2) Two staggered layers of plywood are attached to the top surface of the acoustic layer adding 1½" of thickness.

(3) A finish flooring layer (if wood, ¾" thickness) is typically attached with glue and by nailing through the intervening staggered layers of plywood and the acoustic layer to the subfloor, thereby creating the undesirable sound-bridges between the finish layer and the subfloor.

Advantageously, the flooring assembly of the invention is constructed and attached to a subfloor as follows:

The assembly as described above, ¾"+acoustic layers, saving about 1½" over conventional installation. The assembly of the invention is also advantageous over the assembly described in the above identified patent in that it is considerably thinner, better performing at acoustic attenuation, and less expensive to construct.

The assembly of the invention eliminates at least two of the steps required for the installation of prior art flooring assemblies and results in as much as 1½" thickness saving in overall thickness.

Moreover, the flooring assembly of the invention enables the installation of floors in a one-step process which meet or surpass building sound code requirements [STC and IIC ratings] in most major cities in the world.

The flooring assembly is applicable for the installation of any suitable flooring finish. For example, the finish layer 1 may comprise any suitable material such as, for example, cork, stone, wood, ceramic, metal, fabric, carpet, resin, rubber, polymer, or bamboo.

The acoustic layer 4 and layer 6 may comprise any suitable sound-attenuating construction material, such as, for example, rubber, polymeric, resinous material, fiber matrix material or natural material like cork.

The stability core layer 2 may also comprise any suitable construction material which will provide structural stability to the flooring unit. Exemplary of such materials are wood, rubber, polymeric or resinous material, or a fiber matrix material.

The optional filler layer 3, the backing layer 5, and protection layer 7 each may be constructed from stone, wood, ceramic, metal, fabric, carpet, resinous, rubber, polymeric, or bamboo material While the present invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

I claim:

1. A flooring assembly comprising at least one flooring unit, each said at least one flooring unit consisting of:

a single stability core layer having a top surface, a bottom surface and a plurality of edge surfaces, at least two of said plurality of edge surfaces having an interlocking mechanism for attachment to edge surfaces of a single stability core of adjacent flooring units;

a plurality of unbroken sound attenuating acoustic layers attached to the bottom surface of the single stability core layer; and a finish layer attached to the top surface of said single stability core layer, wherein:

(1) each of said single stability core layer and said sound attenuating acoustic layers are polygonal, and (2) said assembly is attachable to a surface of a structure.

2. The flooring assembly of claim 1, (3) the edges of said sound attenuating acoustic layers in each of said at least one flooring unit overlap the edges of the sound attenuating acoustic layers of adjacent flooring units.

3. The assembly of claim 1 further comprising a filler layer is interposed between said stability core layer and a first of said plurality of sound attenuating layers.

4. The assembly of claim 3 wherein said filler layer comprises stone, wood, ceramic, metal, fabric, carpet, resinous, rubber, polymeric, cork, or bamboo material.

5. The assembly of claim 1 further comprising said backing layer is attachably interposed between said first sound attenuating layer and each succeeding plurality of sound attenuating layers.

6. The assembly of claim 5 wherein said backing layer comprises stone, wood, ceramic, metal, fabric, carpet, resinous, rubber, polymeric, cork, or bamboo material.

7. The assembly of claim 1 wherein each flooring unit further comprises a protection layer attached to the bottom surface of a last of the plurality of sound attenuating layer.

8. The assembly of claim 7 wherein said protection layer comprises stone, wood, ceramic, metal, fabric, carpet, resinous, rubber, polymeric, cork, or bamboo material.

9. The assembly of claim 1 wherein said interlocking mechanisms me tongue and groove construction along opposed lateral edges of said stability core.

10. The assembly of claim 1 wherein said flooring unit is attachable to the surface of a structure by a mechanical connector extending through at least one of said plurality of sound attenuating acoustic layers and/or said backing layer, but not contacting said finish layer, or stability core layer.

11. The assembly of claim 10 wherein said mechanical connector is a nail, screw, staple, bolt, clip or snap.

12. The assembly of claim 11 wherein said mechanical connector is a nail.

13. The assembly of claim 1 wherein said single stability core layer, said plurality of sound attenuating layers and said finish layer are attached to each other by an adhesive.

14. The assembly of claim 1 wherein said finish layer comprises stone, wood, ceramic, metal, fabric, carpet, resin, rubber, polymer, cork or bamboo.

15. The assembly of claim 1 wherein said stability core layer comprises wood, rubber, polymeric, cork, or resinous material, or a fiber matrix material.

16. The assembly of claim 1 wherein said sound attenuating acoustic layer comprises wood, rubber, polymeric, cork, or resinous material, or a fiber matrix material.

17. The assembly of claim 1 is square or rectangular in shape.

18. The assembly of claim 1 wherein said at least one flooring unit is a board.

19. The assembly of claim 1 wherein said surface of a structure is a sub-floor.

20. The assembly of claim 1 wherein each of the plurality of sound attenuating layers addresses a specific frequency range that needs attenuation.

* * * * *